US006895910B2

(12) United States Patent
Geyer et al.

(10) Patent No.: US 6,895,910 B2
(45) Date of Patent: May 24, 2005

(54) TWO-CYCLE ENGINE HAVING SCAVENGING

(75) Inventors: Werner Geyer, Berglen (DE); Jörg Schlossarczyk, Winnenden (DE); Claus Fleig, Ludwigsburg (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 10/439,081

(22) Filed: May 15, 2003

(65) Prior Publication Data

US 2003/0217711 A1 Nov. 27, 2003

(30) Foreign Application Priority Data

May 24, 2002 (DE) ..... 102 23 068

(51) Int. Cl.[7] ..... F02B 33/04
(52) U.S. Cl. ..... 123/73 PP
(58) Field of Search ..... 123/73 PP, 73 A, 123/73 R, 65 A, 65 P

(56) References Cited

U.S. PATENT DOCUMENTS

| | | | | |
|---|---|---|---|---|
| 4,987,864 | A * | 1/1991 | Cantrell et al. | 123/65 BA |
| 6,691,650 | B2 * | 2/2004 | Zama et al. | 123/73 PP |
| 2002/0043227 | A1 | 4/2002 | Carlsson et al. | |

FOREIGN PATENT DOCUMENTS

| | | |
|---|---|---|
| EP | 0 312 162 | 4/1969 |
| FR | 1-006.235 | 4/1952 |
| JP | 11315722 | 11/1999 |
| JP | 2001323816 | 11/2001 |
| WO | WO 01/44634 | 6/2001 |

* cited by examiner

*Primary Examiner*—Tony M. Argenbright
*Assistant Examiner*—Hyder Ali
(74) *Attorney, Agent, or Firm*—Robert W Becker & Associates; Robert W Becker

(57) ABSTRACT

A two-cycle engine, especially for a portable, manually guided implement, has a combustion chamber cylinder in which a piston reciprocates. The engine has at least one transfer channel that fluidically connects the crankcase with the combustion chamber and opens thereinto via an inlet window. The engine has an air channel that supplies essentially fuel-free gas into the cylinder via an air channel window. The piston has at least one piston window establishes a fluidic connection between the air channel window and the inlet window of the transfer channel. The piston has. The distance of the upper edge of the piston window in the direction of the longitudinal axis of the cylinder from the axis of the connecting rod eye of a connecting rod that is connected with the piston is less than the radius of a piston boss for connecting the piston with the connecting rod.

20 Claims, 12 Drawing Sheets

TWO-CYCLE ENGINE HAVING SCAVENGING

BACKGROUND OF THE INVENTION

The present invention relates to a two-cycle engine, especially for a portable, manually guided implement such as a power chain saw, a cut-off machine, a trimmer, or a brush cutter.

WO 01/44634 A1 discloses a two-cycle engine according to which two symmetrically arranged air channels, in prescribed positions of the piston, are connected with a respective transfer channel via piston windows. The air previously collected in the transfer channels serves as a scavenger.

It is an object of the present invention to provide a two-cycle engine of the aforementioned general type that has a small overall size and a low weight.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
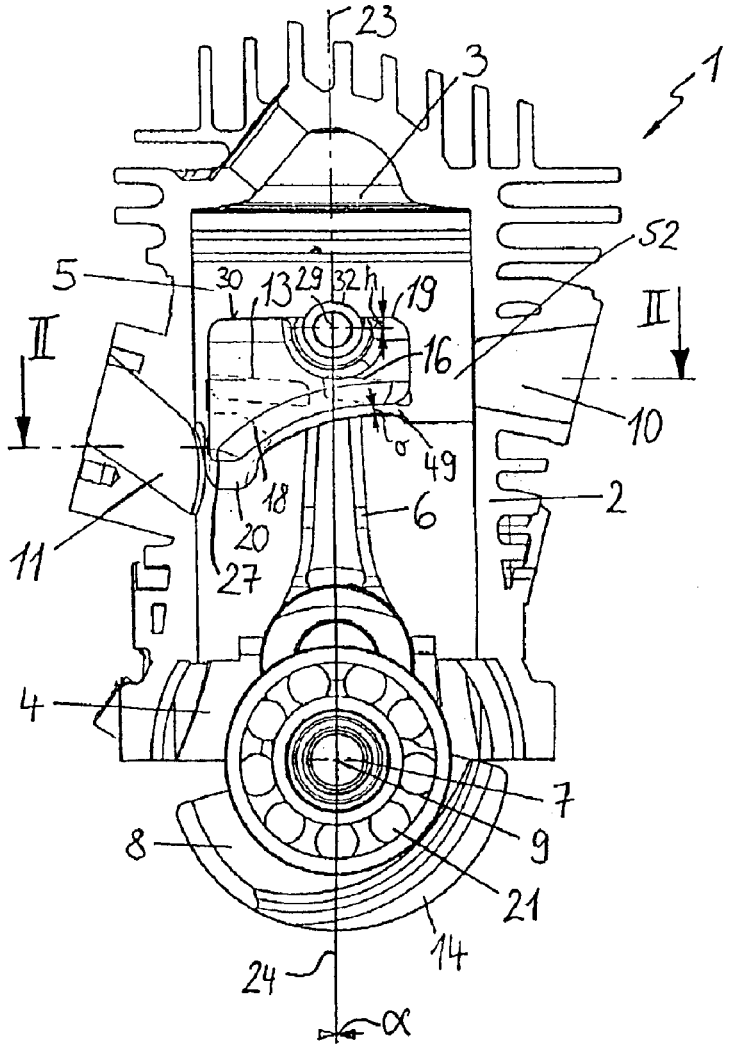
FIG. 1 is a side view of a two-cycle engine with the piston in the upper dead center position.

The two-cycle engine of the present invention comprises a cylinder in which is formed a combustion chamber that is delimited by a reciprocating piston that, via a connecting rod, drives a crankshaft that is rotatably mounted in a crankcase, wherein the connecting rod is connected to the piston at an eye of the connecting rod, wherein an outlet is provided for discharging exhaust gas from the combustion chamber, wherein an inlet is disposed approximately opposite the outlet for supplying a fuel/air mixture to the crankcase, wherein at least one transfer channel is provided for passage of fuel/air mixture out of the crankcase into the combustion chamber, wherein one end of the transfer channel opens into the combustion chamber via an inlet window and another end communicates with the crankcase, wherein at least one air channel is provided that supplies essentially fuel-free gas and that has a window that is disposed in a region of the cylinder that in every position of the piston is separated by the piston from the crankcase and the combustion chamber, wherein a piston window is provided that in a given position of the piston establishes a fluidic connection between the window of the air channel and the inlet windows of the transfer channel, and wherein an upper edge of the piston window is spaced, when viewed in the direction of the longitudinal axis of the cylinder, by a distance from the axis of the connecting rod eye that is less than the radius of a piston boss that is provided for connecting the piston with the connecting rod.

By minimizing the spacing or distance of the upper edge, i.e. of the edge facing the combustion chamber, of the piston window in the direction of the longitudinal axis of the cylinder toward the crankcase relative to the axis of the connecting rod eye, a small overall height is achieved in the direction of the longitudinal axis of the cylinder of the two-cycle engine. The distance of the upper edge of the piston window from the axis of the connecting rod eye is thereby directed in a direction toward the crankcase; in other words, the distance is negative if the upper edge of the piston window relative to the crankcase has a greater spacing than does the axis of the connecting rod eye. In these instances the distance is always less than the radius of the piston boss. Thus, advantageous conditions result if the upper edge of the piston window is offset relative to the axis of the connecting rod eye in the direction toward the combustion chamber, or if the upper edge is offset in the direction toward the crankcase at most by a distance that corresponds to the radius of the piston boss. The low overall height of the cylinder simultaneously leads to a low overall weight of the two-cycle engine. In addition, the control surfaces on the piston are well utilized.

In this case, the piston boss represents the mounting means for the wrist pin. In particular, the spacing or distance is less than 50% of the radius of the piston boss. An advantageous arrangement is where the upper edge of the piston window extends in the region of the axis of the connecting rod eye. It is provided that a sealing member extend about the piston boss. This sealing member in particular prevents a fluidic connection between piston window and crankcase via the piston boss. In the direction toward the piston window, the sealing member expediently has a width of 2 to 4 mm. For a good sealing, the radial distance between sealing member and the inner wall of the cylinder is, in every position of the piston, at most 0.1 mm, especially less than 50 $\mu$m. To improve the sealing properties, the sealing member has at least one circumferential sealing groove. A plurality of circumferential sealing grooves can be expedient.

A reduction of the weight, and a shortening of the overall height, result if the lower edge of the piston, on that side that faces the outlet, has an offset in the direction of the upper side of the piston on that side that faces the inlet. A good scavenging result, and favorable exhaust gas values, are achieved if two air channel windows and four transfer channels are disposed symmetrically relative to the longitudinal axis of the cylinder.

In order despite the low overall height to be able to realize favorable control times, it is provided that the piston be extended in a direction toward the crankcase in the region of the piston window. The height of the extension of the piston window is expediently less than 15%, in particular less than 10%, of the piston height on that side of the piston that faces the inlet. The piston window expediently has an approximately L-shaped configuration, whereby the short leg of the L projects downwardly in the direction of the longitudinal axis of the cylinder. An L-shaped configuration of the piston window enables adequately long control times with a compact construction of the two-cycle engine. To shorten the overall height, the crank web has a flattened portion on that side thereof that faces the crankcase. In this way, a collision of the piston with the crank web can be avoided, even if the piston, in the lower dead center position, is disposed in the rotational region of the crank web. The flattened portion is advantageously embodied as a chamfer having a chamfer angle $\gamma$. The base surface of the piston window is expediently inclined relative to the rear wall of the piston window by an angle of inclination $\beta$ of more than 90°, whereby the angle of inclination in particular corresponds to the chamfer angle. An angle of inclination of 120 to 150° is advantageous.

It is provided that in the upper dead center position of the piston, the distance between upper edge of the piston and crankshaft axis, relative to the ratio of piston stroke to cylinder bore diameter, be 130 to 153 mm, in particular 137 to 145 mm. At a piston stroke of 34 mm, and a cylinder bore diameter of 49 mm, there thus results for the distance advantageous values of 90 to 105 mm, in particular 94 to 100 mm. In the lower dead center position of the piston, the distance between upper edge of the piston and crankshaft axis, relative to the ratio of piston stroke to cylinder bore diameter, is 72 to 116 mm, in particular 86 to 102 mm. At a piston stroke of 34 mm, and a cylinder bore diameter of 49 mm, the distance is advantageously thus 50 to 80 mm, in particular 60 to 70 mm. These piston relationships enable a short construction. At the same time, there thereby result adequately long control times for a good output at low exhaust gas values. The control surfaces on the piston are well utilized. Good control times are achieved if in the lower dead center position of the piston, the distance between air channel window and upper edge of the piston is 0.5 to 5.0 mm, in particular 1.0 to 3.0 mm. At these dimensions, at the same time a good sealing is ensured between air channel and combustion chamber. An adequate sealing between air channel and crankcase is achieved if in the lower dead center position the distance between the lower edge of the piston and the bearing means of the crankshaft is 0.5 to 3.0 mm, in particular approximately 1 mm.

To be able to realize large cross-sections of the inlet windows, the transfer channels, and the air channel window at a short overall height, and to be able to well utilize the control surfaces on the piston, it is provided that the air channel window be offset relative to at least one inlet window of a transfer channel in the direction toward the crankcase, and in particular to have a positive spacing relative to the inlet window.

The piston advantageously has a cavitation from the piston skirt into the interior, whereby during the course of the piston stroke the cavitation is fluidically connected with only one functional opening into the interior of the cylinder, especially with at least one inlet window of a transfer channel, and the cavitation establishes no connection to the crankcase. The term functional opening here refers to all openings having a unitary function, in other words, the inlet windows of the transfer channels together form a functional opening, the air channel windows together form a functional opening, and the inlet and outlet respectively form individual functional openings. Due to the cavitation that extends from the outer side of the cylinder into the solid material of the piston, a reduction in weight of the pistons is achieved. Due to the fact that the cavitation is in communication with only one functional opening, control times and fuel/air ratio are not affected.

The cavitation is expediently spaced in the circumferential direction relative to all functional openings with which it is not connected during the course of a piston stroke. To achieve a good sealing of the cavitation, it is provided that the cavitation have at least one sealing member that extends all the way around, and the width of which is advantageously at least 1 mm, especially 2 to 4 mm. The sealing member expediently has at least one circumferential sealing groove. The cavitation is advantageously composed of a plurality of individual cavitations. In this connection, the individual cavitations are in particular separated from one another by ribs. In this way, a good guidance of the piston is achieved while at the same time reducing the weight thereof.

For a good scavenging behavior with a low overall size of the two-cycle engine, it is provided that the piston windows have an overall volume that corresponds to approximately 4 to 14% of the stroke volume or displacement, i.e. the difference of the volumes of the combustion chamber in the upper and lower dead center positions of the piston. To prevent fuel-free air from passing out of the air channel into the crankcase via the piston window, it is provided that at least one circumferential sealing member be formed on the piston window. The width of the sealing member between piston window and crankcase is expediently at least 1 mm, especially 2 to 4 mm. To improve the sealing, it is provided that a sealing member have at least one circumferential sealing groove.

Further specific features of the present invention will be described in detail subsequently.

DESCRIPTION OF PREFERRED EMBODIMENTS

Referring now to the drawings in detail, the two-cycle engine 1 illustrated in FIG. 1 has a combustion chamber 3 that is formed in a cylinder 2 and that is delimited by a reciprocating piston 5. By means of a connecting rod 6, the piston 5 drives a crankshaft 7 that is rotatably mounted about a crankshaft axis 9 in a crankcase 4 via a ball bearing 21. The crankshaft 7 includes two crank webs 8 that are disposed symmetrically relative to the connecting rod 6 and that each have a flattened portion 14 on that side thereof that faces the crankcase 4. The two-cycle engine 1 has an inlet 11 for the supply of fuel/air mixture to the crankcase 4, and an outlet 10 for the discharge of exhaust gases out of the combustion chamber 3. The piston 5 has two symmetrically arranged piston windows 19 that have an L-shaped configuration, whereby the short leg 27 of the L faces the inlet 11 in a direction of the longitudinal axis 23 of the cylinder 2. Since the short leg 27 extends downwardly beyond the remainder of the piston 5, a respective nose 20 is formed on the piston 5 on both sides of the inlet 11 in the region of the short leg 27. Formed on the piston window 19 is a sealing member 49 that extends all the way around; the width o of the sealing member 49 between the piston window 19 and the crankcase 4 is 2 mm to 4 mm. In the direction toward the combustion chamber 3, and in the circumferential direction, the sealing member 49 is formed by the piston skirt 52. It can be expedient for the sealing member 49 to have a circumferential sealing groove. A plurality of sealing grooves can also be advantageous.

Figure 2:
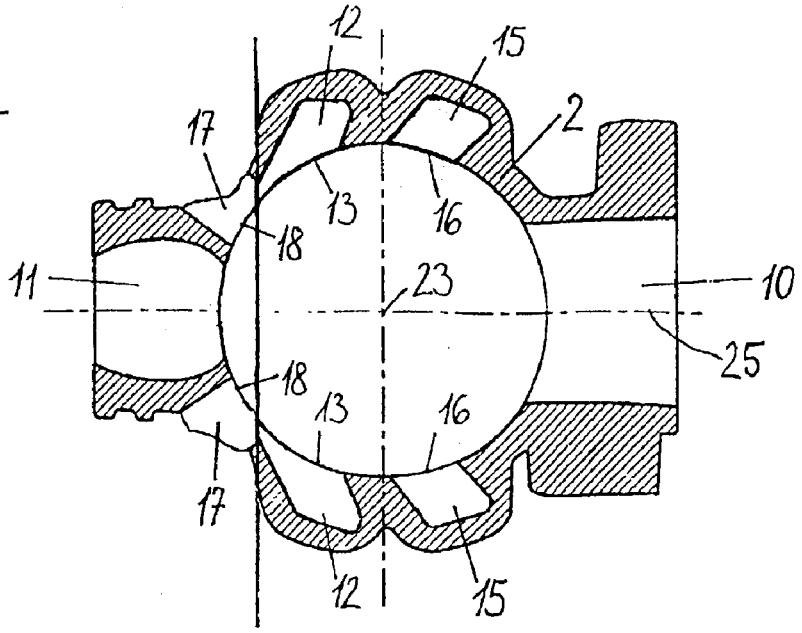
FIG. 2 is a cross-sectional view through the cylinder of a two-cycle engine taken along the line II—II in FIG. 1.

The combustion chamber 3 is fluidically connected with the crankcase 4 via the transfer channels 12 and 15, which are schematically illustrated in cross-section in FIG. 2. The transfer channels 12, 15 are symmetrically arranged relative to the longitudinal axis 23 of the cylinder 2 and to the center line 25 of the inlet 11 and outlet 10, and open into the combustion chamber 3 via inlet windows 13 and 16. Disposed below the inlet window 13, i.e. offset in a direction toward the crankcase 4, is the air channel window 18 via which the air channel 17 opens into the cylinder 2. The air channel window 18 is disposed in a region of the cylinder wall that in every piston position is separated by the piston 5 from the combustion chamber 3 and from the crankcase 4.

In the upper dead center position of the piston 5 illustrated in FIG. 1, fuel/air mixture flows through the inlet 11 into the crankcase 4. The crank angle α, which indicates the angle between the longitudinal axis 23 of the cylinder 2 and the center line 24 of the crank web 8, is 0° in this piston position. By means of the piston window 19, the air channel windows 18 and the inlet windows 13 and 16 of the transfer channels 12 and 15 are fluidically interconnected, so that air can flow out of the air channels 17 via the piston windows 19 and through the transfer channels 12 and 15 in the direction toward the crankcase 4. The distance a between the upper edge 22 of the piston 5 and the axis 9 of the crankshaft 7 is about 95.5 mm in the upper dead center position. With a piston stroke of 34 mm, and a cylinder bore diameter of 49 mm, the distance a is advantageously 90 to 105 mm, especially 94 to 100 mm. Relative to the ratio of piston stroke to cylinder bore diameter, the distance a ranges from 130 to 153 mm, especially 137 to 145 mm. The ratio of the distance a to the piston stroke is expediently 2.6 to 3.1, especially 2.7 to 3.0.

Figure 13:
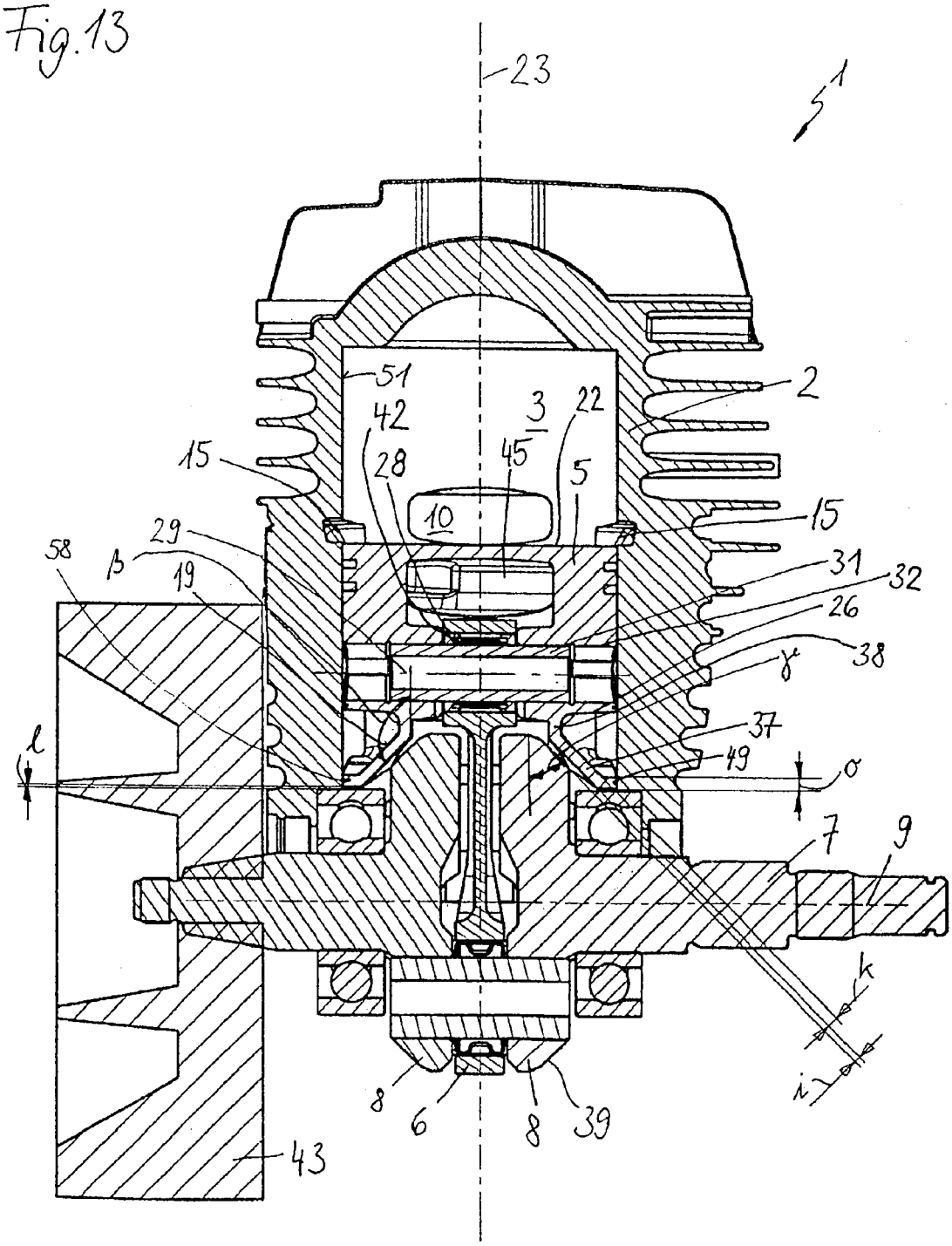
FIG. 13 is a cross-sectional view taken along the line XIII—XIII in FIG. 12.

As illustrated in the cross-sectional view in FIG. 13, the connecting rod 6 is mounted in the piston boss 32 via the wrist pin 31 of the piston 5. The wrist pin 31 extends from the piston boss 32 through the eye 28 of the connecting rod 6 to the opposite side of the piston boss 32. The piston boss thus represents the bearing means of the wrist pin 31. Disposed in the eye 28 of the connecting rod 6 is a bearing means 42 via which the connecting rod 6 is pivotably held on the wrist pin 31. The upper edge 30 of the piston window 19 illustrated in FIG. 1 is offset relative to the axis 29 of the connecting rod eye 28 in a direction toward the combustion chamber 3. The upper edge 30 is thereby the edge of the piston 19 that faces the combustion chamber 3. The axis 29 of the connecting rod eye 28 has a spacing h relative to the upper edge 30 of the piston window 19 in the direction of the longitudinal axis 23 of the cylinder 2. The upper edge 30 of the piston window 19 is disposed in the region of the axis 29 of the connecting rod eye 28.

Figure 3:
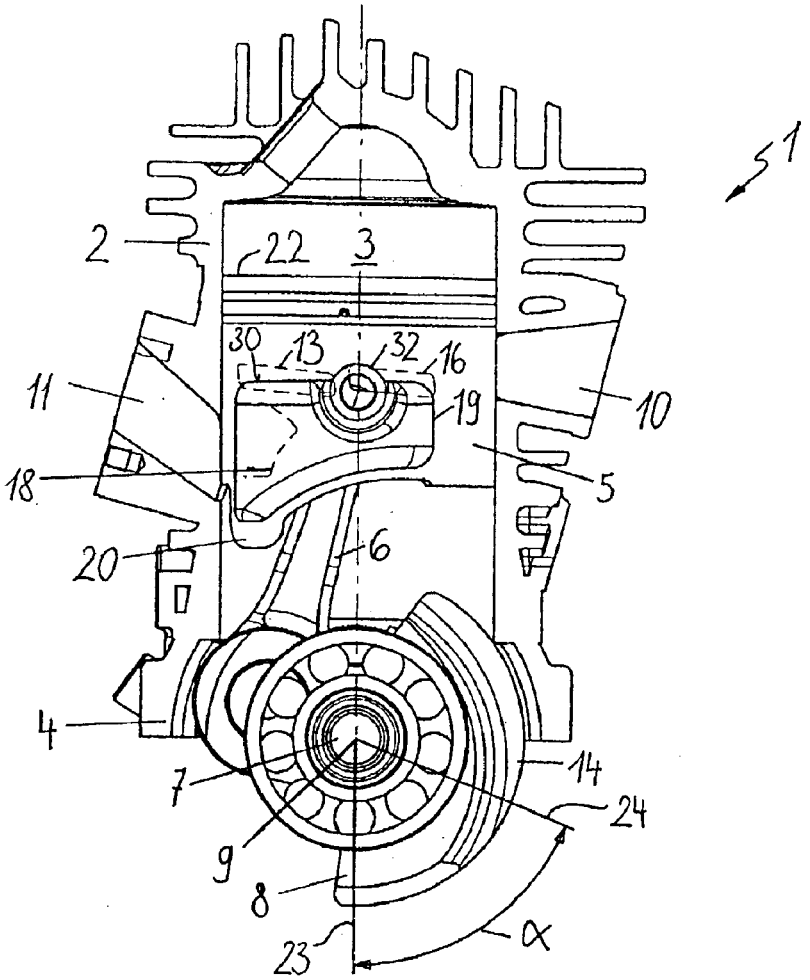
FIG. 3 is a side view of the two-cycle engine of FIG. 1 during downward movement of the piston.
Figure 4:
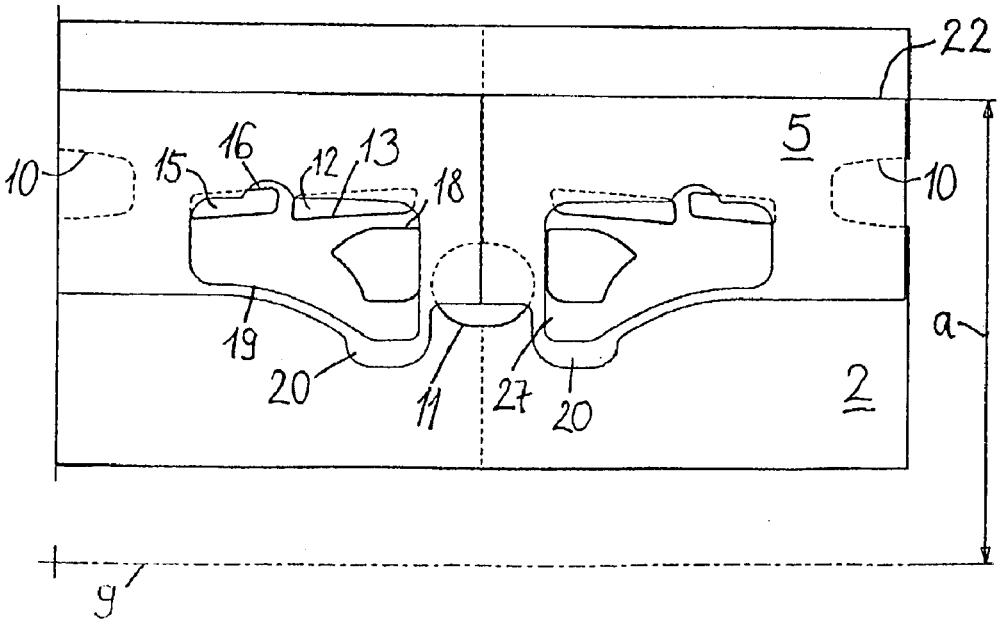
FIG. 4 is a development of the cylinder and piston at the piston position illustrated in FIG. 3.

In FIGS. 3 and 4, the two-cycle engine 1, and a development of the piston 5 and cylinder 2, are illustrated in a position in which the crank angle α is approximately 68°. In this position of the piston, the distance a is about 83.6 mm, relative to the ratio of piston stroke to cylinder bore diameter therefore about 121 mm. The inlet 11 is still open, and the air channel windows 18 are connected via the piston windows 19 with the inlet windows 13 and 16 of the transfer channels 12 and 15, so that fuel/air mixture, and largely fuel-free air, flow into the combustion chamber 3. The outlet 10 out of the combustion chamber 3 is closed off by the piston 5. In FIG. 4, the piston boss 32 and wrist pin 31 are not illustrated. The piston 5 is moving downwardly, in other words is moving from the combustion chamber 3 in the direction toward the crankcase 4.

Figure 5:
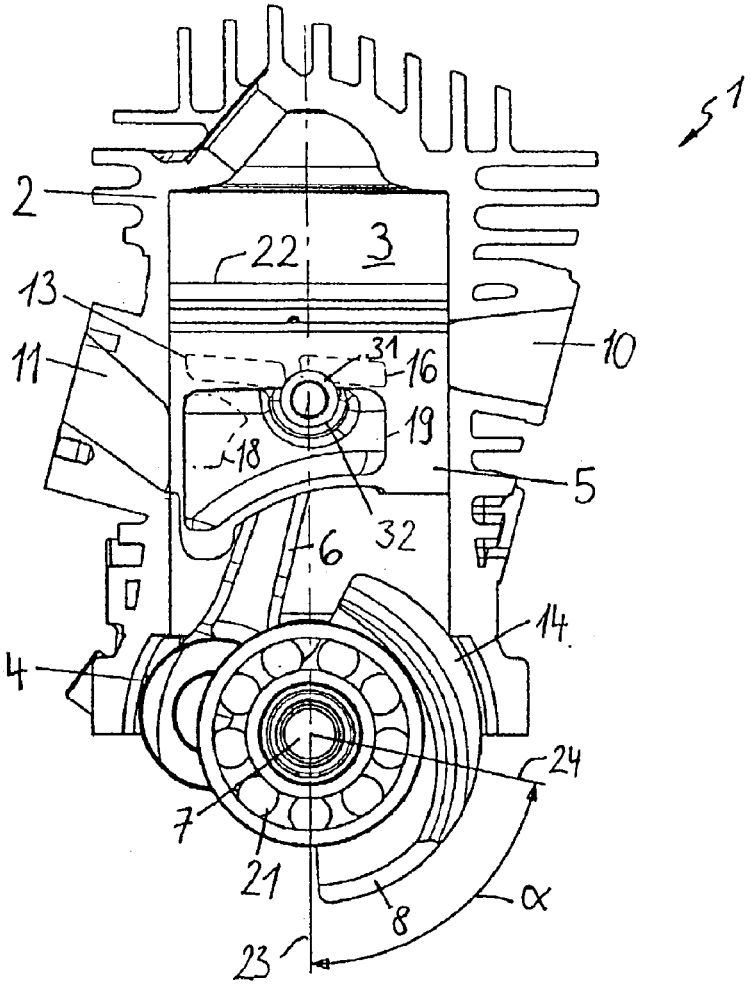
FIG. 5 is a side view of the two-cycle engine of FIG. 1 during further downward movement of the piston out of the position illustrated in FIG. 3.
Figure 6:
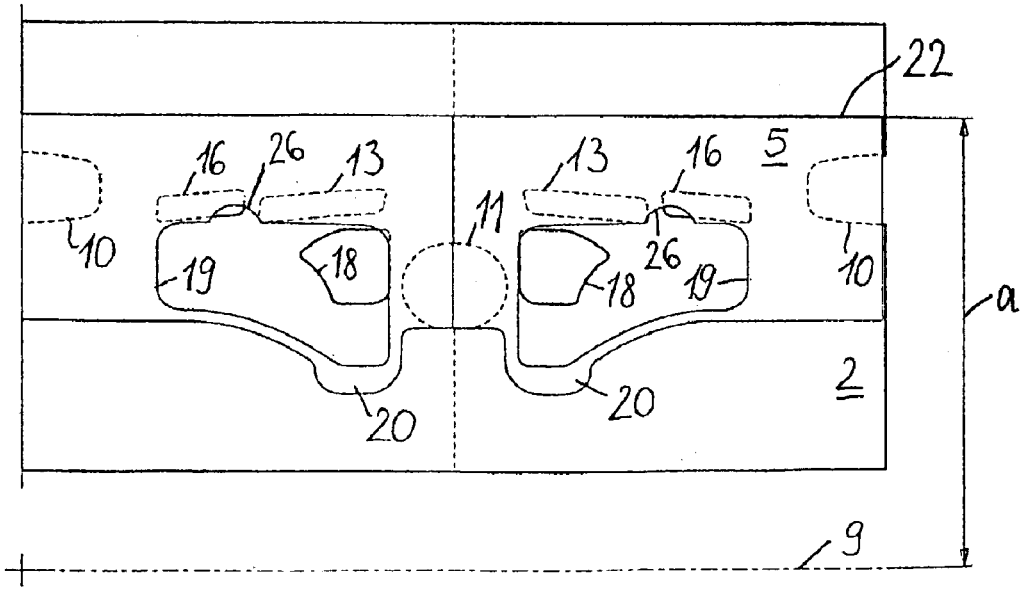
FIG. 6 is a development of the cylinder and piston at the piston position illustrated in FIG. 5.

FIGS. 5 and 6 show the two-cycle engine 1, and the development of the piston 5 and cylinder 2, after a further downward movement of the piston 5. In this position the crank angle α is approximately 78° and the distance a is approximately 79.7 mm. The inlet 11 and the transfer channels 12, 15 are completely closed off by the piston 5. The cut-out 26 of the piston window 19 is covered by the piston boss 32 and the wrist pin 31, which are not illustrated in FIG. 6.

Figure 7:
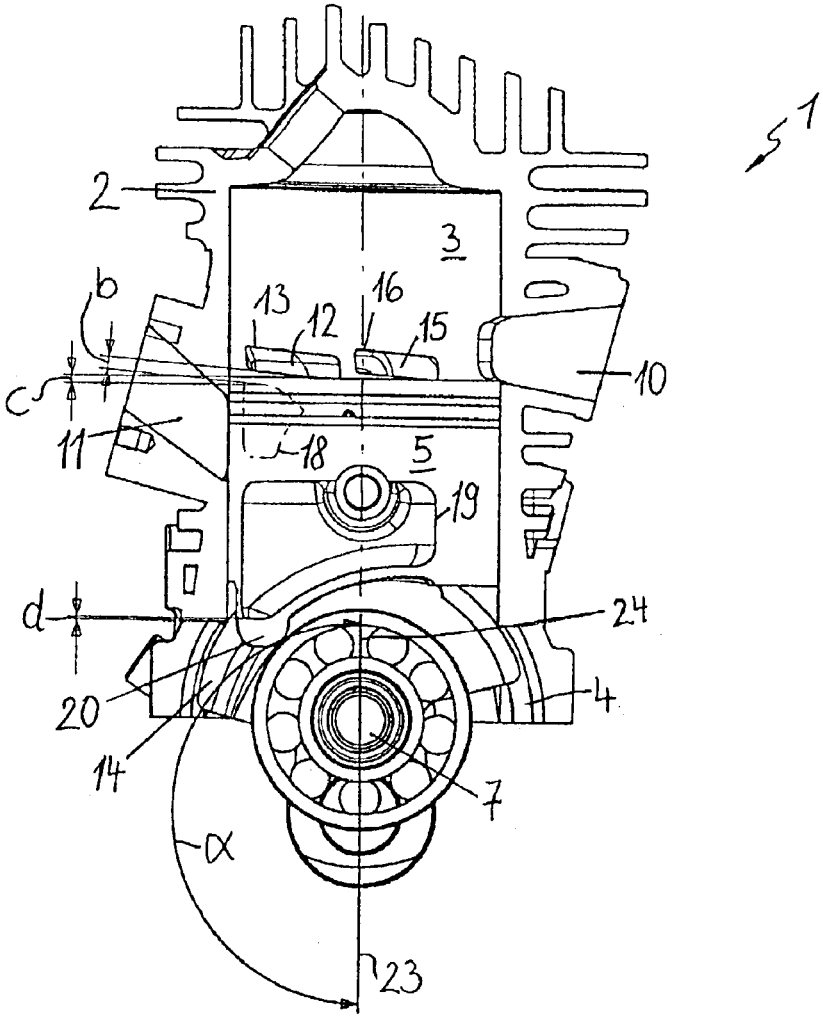
FIG. 7 is a side view of the two-cycle engine in FIG. 1 with the piston in the lower dead center position.
Figure 8:
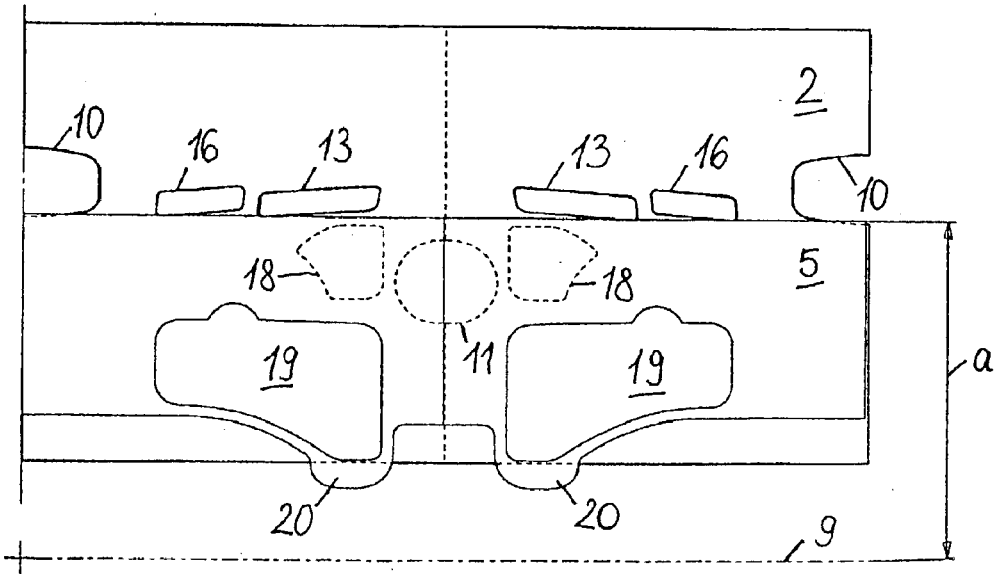
FIG. 8 is a development of the cylinder and piston in the lower dead center position.

In FIGS. 7 and 8, the piston 5 is illustrated in the lower dead center position. In this position of the piston, the crank angle α is 180°. The nose 20 of the piston 5 is disposed in the region of the crank web 8. The flattened portion 14 on the crank web 8 prevents a collision between the crank web 8 and the nose 20 of the piston 5. The distance d between the lower edge of the cylinder and the lower edge of the piston window 19 is about 1 to 2 mm in this position of the piston, whereby the piston window 19 is disposed above the cylinder edge and is thus closed off by the cylinder wall relative to the crankcase 4. The distance d thus designates the width of the sealing member between the piston window 19 and the crankcase 4. The air channel window 18 as well as the inlet 11 are closed off by the piston 5. The distance c between the upper edge of the air channel window 18 and the upper edge 22 of the piston is, in this position of the piston, about 1.5 mm, whereby distances c of 0.5 to 5.0 mm are advantageous. In this connection, the distance c at the same time designates the width of the sealing member between the air channel window 18 and the combustion chamber 3 in the lower dead center position of the piston 5. The distance b between the inlet window 13 of the transfer channel 12 and the upper edge of the air channel window 18 is about 2 mm. In this connection, the distance b designates the width of the sealing member between the air channel window 18 and the inlet window 13 when the latter are closed by the piston skirt. The distance a between the crankshaft axis 9 and the upper edge 22 of the piston is about 61.5 mm in the lower dead center position. The distance a relative to the ratio of piston stroke to cylinder bore diameter is advantageously 72 to 116 mm, especially 86 to 102 mm. In the lower dead center position, the ratio of the distance a to the piston stroke is expediently 1.4 to 2.4, especially 1.7 to 2.1. The transfer channels 12, 15 open into the combustion chamber 3, so that first the air in the transfer channels 12, 15, and subsequently fuel/air mixture from the crankcase 4, flow into the combustion chamber 3. The outlet 10 out of the combustion chamber 3 is opened, so that exhaust gases present in the combustion chamber are displaced into the outlet 10 by the air and/or fuel/air mixture that is flowing in.

Figure 9:
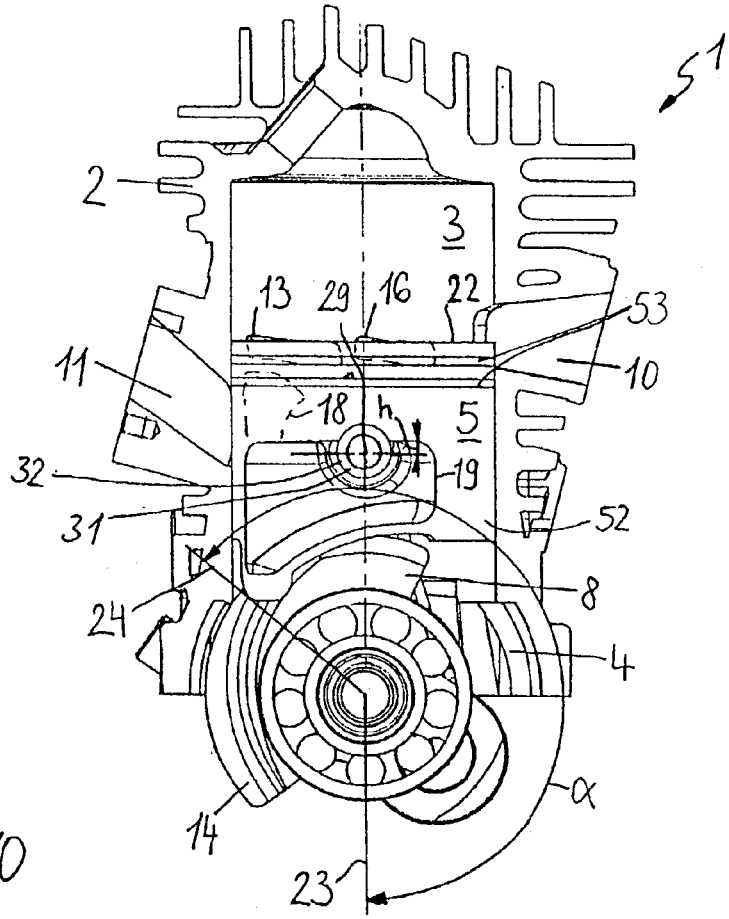
FIG. 9 is a side view of the two-cycle engine of FIG. 1 during upward movement of the piston.
Figure 10:
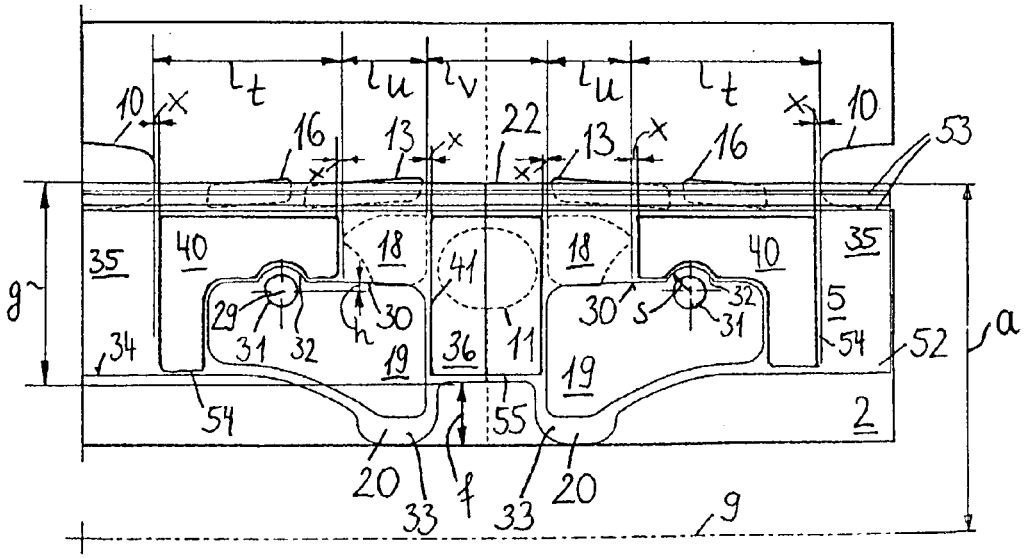
FIG. 10 is a development of the cylinder and piston at the piston position illustrated in FIG. 9.

FIGS. 9 and 10 show the piston 5 during an upward movement, i.e. during movement, out of the lower dead center position, from the crankcase 4 in a direction toward the combustion chamber 3. The crank angle α is about 230°, and the distance a is about 66.1 mm. The noses 20 are still in the region of the crank web 8. The inlet windows 13 and 16 of the transfer channels 12 and 15 are closed off by the upwardly moving piston 5. During further upward movement of the piston 5, air begins to flow into the piston window 19 from the air channel window 18. The outlet 10 is opened, so that exhaust gases continue to flow out of the combustion chamber 3.

The symmetrically arranged noses 20 represent extensions 33 of the piston 5 in a direction toward the crankcase 4. In this connection the extensions 33 have a height f relative to that side 36 of the piston 5 that faces the inlet 11. On that side 35 of the piston 5 that faces the outlet 10, the lower edge 34 of the piston 5 is offset relative to the side 36 that faces the inlet 11 by an offset e in a direction toward the upper side 22 of the piston (see FIG. 11). The offset e is advantageously 1 to 15% of the piston height g on that side 36 of the piston 5 that faces the inlet 11, and in particular is 2 to 10%. The piston height g is advantageously 30 to 50 mm, especially 35 to 45 mm. The distance h from the axis 29 of the connecting rod eye 28, in the direction of the longitudinal axis 23 of the cylinder, toward the crankcase 4, relative to the upper edge 30 of the piston window 19 is negative for the piston 5 illustrated in FIGS. 1 to 10. The height h is advantageously less than the radius s of the piston boss 32; in particular, the distance h is less than 50% of the radius s of the piston boss 32. However, it can also be expedient to offset the upper edge 30 of the piston 19 above, i.e. in a direction toward the combustion chamber 3, relative to the piston boss 32. The piston boss 32 is in particular completely surrounded by the piston window 19. The piston boss 32 expediently has at least one circumferential sealing member that in particular has at least one circumferential sealing groove.

To reduce the weight of the piston 5, the latter is provided with cavitations 40, 41 from the piston skirt 52 into the interior, as illustrated in FIG. 10. During the course of a piston stroke, each cavitation 40, 41 is fluidically connected with only one functional opening. In this connection, the term functional opening includes all openings into the interior of the cylinder that have a unitary function. Thus, all of the inlet windows 13, 16 of the transfer channels 12, 15 together form a functional opening; the two air channel windows 18 together form a functional opening; the inlet 11 forms a functional opening; and the outlet 10 forms a functional opening. The maximum width of the cavitations 40, 41 introduced into the piston skirt 52 is determined over the width or distance of the functional openings in the circumferential direction. As illustrated in FIG. 10, the air channel windows 18 have a width u in the circumferential direction. A maximum width for a cavitation 40, which is connected with the inlet windows 13, 16 of the transfer channels 12, 15 in certain positions of the piston 5, results from the distance t between the air channel windows 18 and the outlet 10.

To avoid a fluidic connection from being established between adjacent functional openings, such as the inlet windows 13, 16 of the transfer channels 12, 15, and the outlet 10, in the course of a piston stroke, it is provided that a cavitation 40 have a spacing x in the circumferential direction from adjacent functional openings. Thus, the cavitation 40 respectively has a spacing x relative to the outlet 10 and to the adjacent air channel window 18. For a good sealing, it is furthermore provided that the cavitation 40 have a sealing edge 54 that extends all the way around. The height of the cavitation 40 in the direction toward the upper edge 22 of the piston 5 is delimited by the piston rings 53, and in the direction toward the crankcase 4 is delimited by the piston window 19 as well as by the lower edge 34 of the piston 5.

A further cavitation 41 is provided in the region of the inlet 11. This cavitation also has a spacing x in the circumferential direction toward the two adjacent air channel windows 18 or to the piston windows 19. The cavitation 41 has a sealing edge 55 that extends all the way around. The extension of the cavitation 41 in the direction of the longitudinal axis 23 of the cylinder is thus delimited in the direction toward the upper edge 22 of the piston by the piston rings 53, and in the direction toward the crankcase by the lower side of the piston.

It can be advantageous to dispose the air channel window 18 below a transfer channel 15 that is close to the outlet 10. In addition, arranging the short leg 27 of the L on that side that is remote from the inlet 11 can also be advantageous, as can be a T-shaped configuration of the air channel window 18. When considering the arrangement of the air channel window 18, one should also consider a good utilization of the control surfaces that are available on the piston 5.

Figure 11:
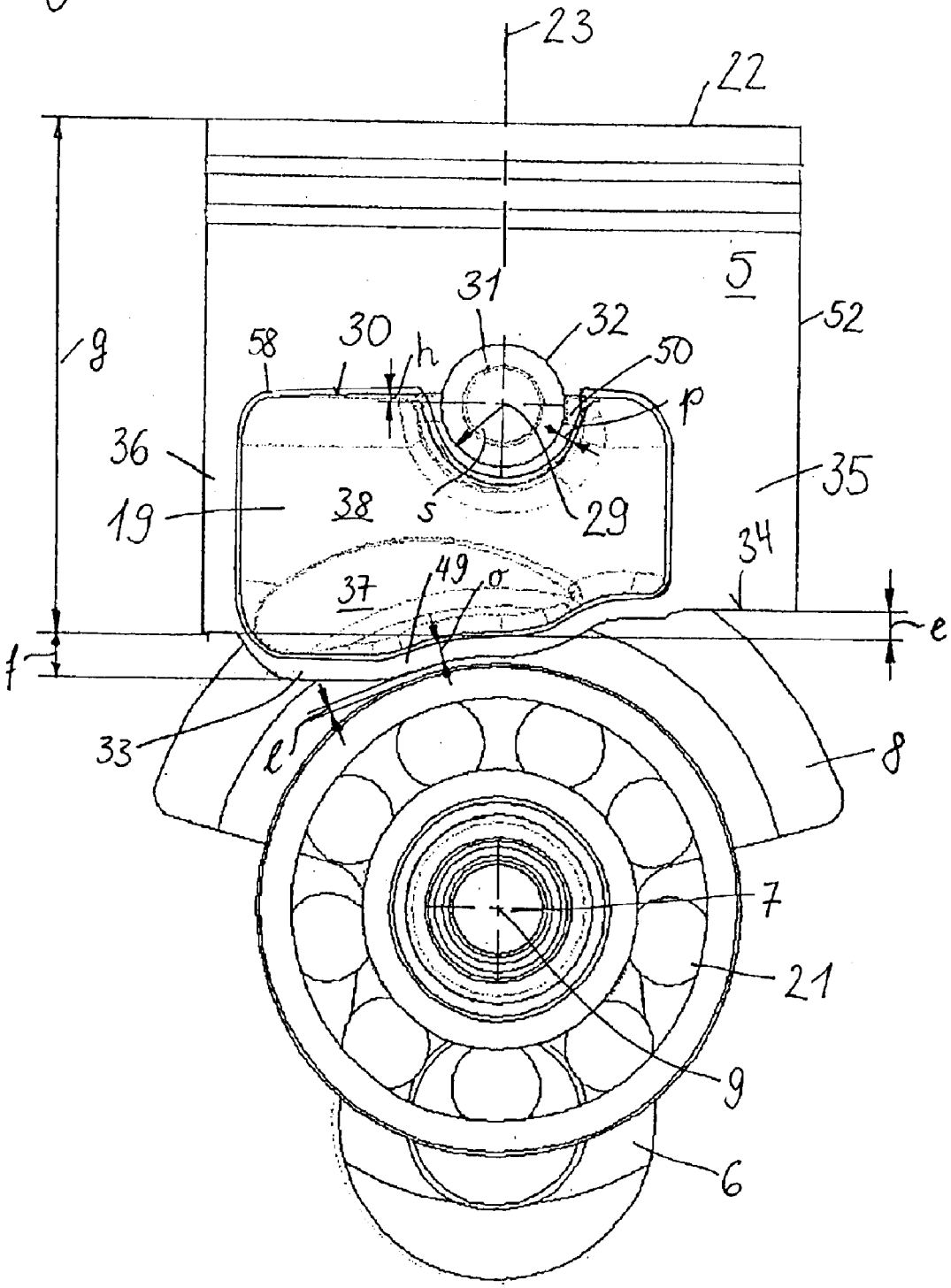
FIG. 11 is a side view onto the piston with connecting rod, crankshaft and crankshaft bearing means.

Illustrated in FIG. 11, in the lower dead center position, is a piston 5 with a connecting rod 6, a crankshaft 7, a crank web 8, and the ball bearing 21 of the crankshaft 7. The piston 5 is connected with the connecting rod 6 via a wrist pin 31, which has a tubular configuration and is mounted in the boss 32 of the piston 5. The piston boss 32 has a radius s. The piston 5 has two piston windows 19 that are disposed symmetrically relative to the longitudinal axis 23 of the cylinder; one of the piston windows 19 is illustrated in FIG. 11. The piston window 19 has a rear wall 38 and a base surface 37. The upper edge 30 of the piston window 19, which is that edge of the piston window 19 that faces the upper edge 22 of the piston, is offset relative to the axis 29 of the eye 28 in the direction toward the upper edge 22 of the piston. As viewed in the direction toward the crankcase 4, the axis 29 of the connecting rod eye 28 has a negative spacing h from the upper edge 30. However, the spacing h can also be positive. The spacing or distance h is advantageously less than the radius r of the connecting rod eye 28, which radius is illustrated in the cross-section in FIG. 12. In particular, the distance h is less than the radius s of the piston boss 32. It is advantageously less than 50% of the radius s of the piston boss 32. In the illustration in FIG. 11, the upper edge 30 is disposed approximately in the region of the axis 29. However, it can also be advantageous, for the further minimizing of the overall height, to offset the upper edge 30 relative to the piston boss 32 in a direction toward the upper edge 22 of the piston. In so doing, the amount of the distance h becomes greater than the radius s of the piston boss; however, due to the direction being opposite to the direction toward the piston housing the distance h is negative.

Extending about the piston boss 32 is a sealing member 50 that in a direction toward the piston window 19 has a width p of 2 to 4 mm. The sealing member 50 advantageously has at least one circumferential sealing groove. Formed on the piston window 19 is a circumferential sealing member 49 that in the circumferential direction of the piston 5, and in the direction toward the upper side 22 of the piston, is formed by the piston skirt 52. Between the piston window 19 and the crankcase 4, the sealing edge or member 49 has a width o of at least 1 mm. The width o is expediently 2 to 4 mm. The sealing member 29 advantageously has at least one circumferential sealing groove 58. For a good flow-through of the piston window 19, an overall volume of the piston window 19 of 4 to 14% of the stroke or displacement volume of the two-cycle engine 1 is provided.

In the region of the piston window 19, the piston 5 is extended in the direction toward the crankcase 4. The extension 33 has a height f relative to that side 36 of the piston 5 that faces the inlet 11. The piston height g extends from the lower edge 34 on that side 36 of the piston 5 that faces the inlet 11 to the upper edge of the piston parallel to the longitudinal axis 23 of the cylinder. The height f of the extension 33 is advantageously less than 15%, and in particular less than 10%, of the piston height g. In the region of the ball bearing 21 of the crankshaft 7, the distance I between the bearing 21 and the extension 33 of the piston 5, in the lower dead center position of the piston 5 illustrated in FIG. 11, is advantageously 0.5 to 3 mm, especially approximately 1 mm. In the lower dead center position, the crank web 8 is disposed in the region of the piston 5.

Figure 12:
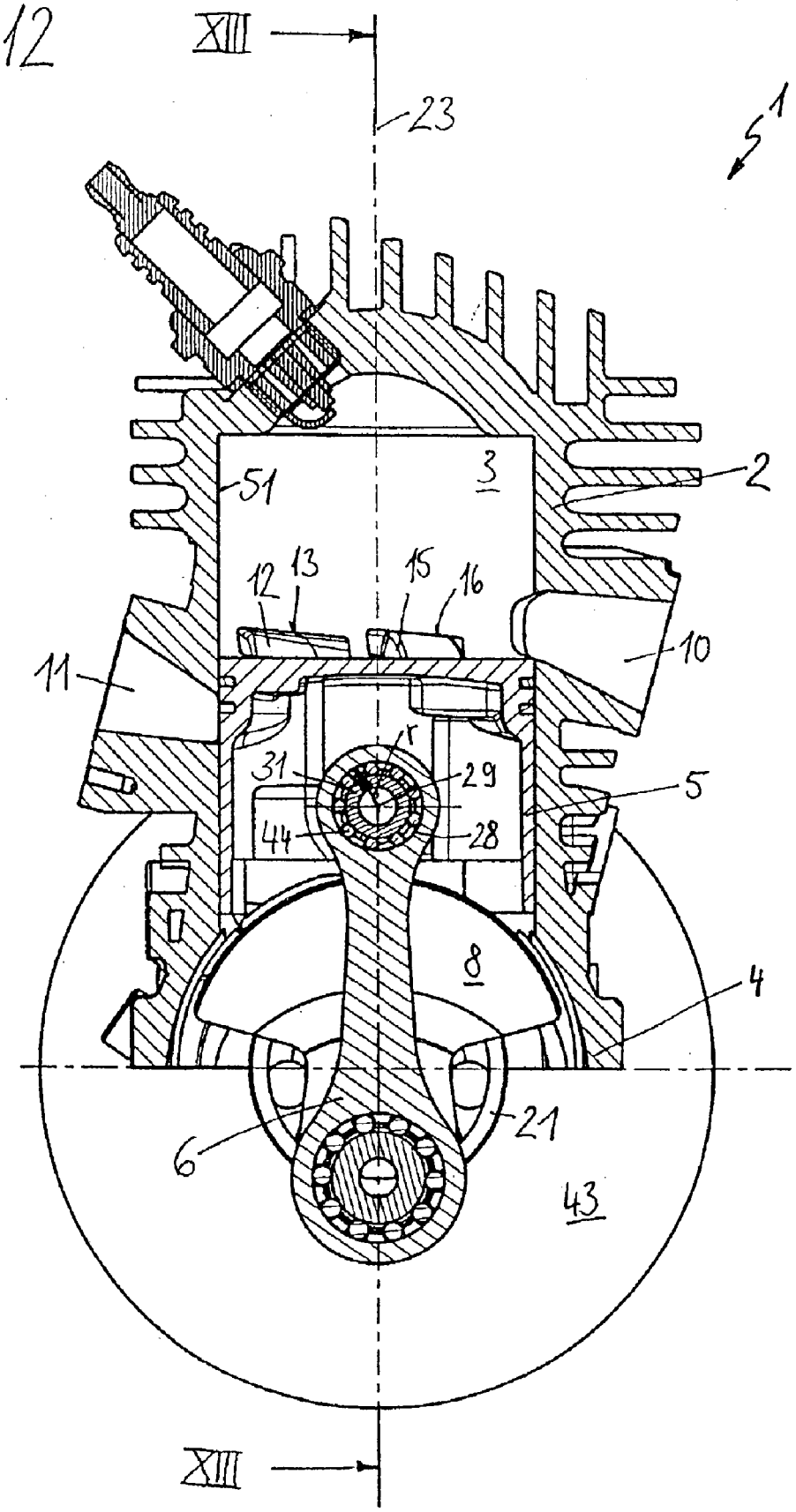
FIG. 12 is a longitudinal cross-sectional view through a cylinder having a piston disposed therein in the lower dead center position.

In FIG. 12, the two-cycle engine 1 is illustrated in a longitudinal cross-section along the center line 25 of the outlet 10 and inlet 11. The piston 5 is in the lower dead center position, in which the crank web 8 is disposed in the region of the piston 5. The connecting rod 6, at the connecting rod eye 28, is mounted on the wrist pin 31 via a needle bearing 44. To reduce weight, the wrist pin 31 is hollow. Disposed on the crankshaft, which is not illustrated in FIG. 12, is a fan wheel 43 for cooling the engine 1. The crankshaft is mounted in the crankcase 4 via the ball bearing 21. For a good sealing, the radial spacing between the inner wall 51 of the cylinder and the sealing member 49 at the piston window 19, or the sealing member 50 at the piston boss 32, is, in every position of the piston 5, less than 0.1 mm, and in particular less than 50 $\mu$m.

A cross-sectional view taken along the line XIII—XIII in FIG. 12 is illustrated in FIG. 13. The crank web 8 is flattened on that side that faces the crankcase 4. The lower half of the crankcase 4 is not illustrated in FIGS. 12 and 13. The flattened portion is embodied as a chamfer 39, whereby the chamfer angle $\gamma$ is approximately 45°. However, other chamfer angles can also be expedient. The base surface 37 of the piston window 39 is inclined at an angle of inclination $\beta$ relative to the rear wall 38 of the piston window 19. The angle of inclination $\beta$ expediently corresponds to the chamfer angle $\gamma$. For the piston illustrated in FIG. 13, the angle of inclination $\beta$ is 135°. The sum of the chamfer angle $\gamma$ and the angle of inclination $\beta$ is expediently 180°. The rear wall 38 of the piston window 19 extends approximately parallel to the longitudinal axis 23 of the cylinder. The distance i between the chamfer 39 of the crank web 8 and the base surface 37 of the piston window 19 is, in the lower dead center position, approximately 1 mm, whereby distances i of 0.5 to 5 mm are expedient. The thickness k of the base surface 37 is advantageously 1 to 5 mm, especially about 2 mm. The wrist pin 31, via which the connecting rod 6 is mounted in the piston 5, does not extend completely through the piston 5. Disposed on the crankshaft 7 is a fan wheel 43. Disposed in the piston 5, as viewed from the wrist pin 31 in the direction toward the combustion chamber 3, is a recess 45 that extends to below the upper side of the piston. To minimize the weight of the piston 5, the recess 45 should be as large as possible.

Figure 14:
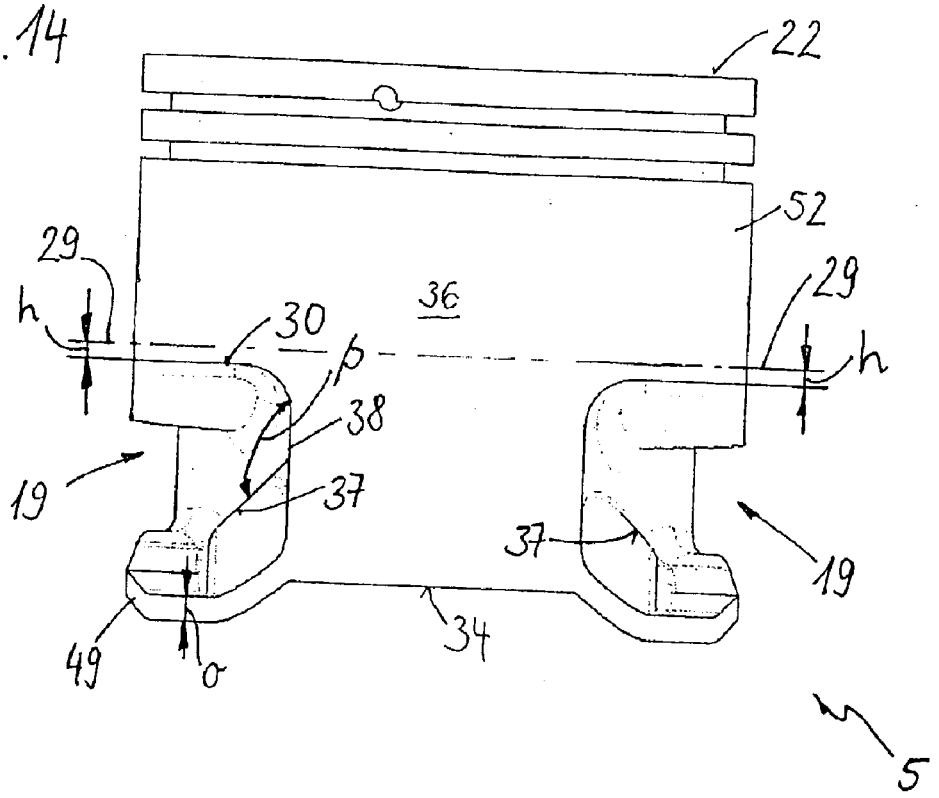
FIGS. 14 & 15 are perspective views onto a piston.
Figure 15:
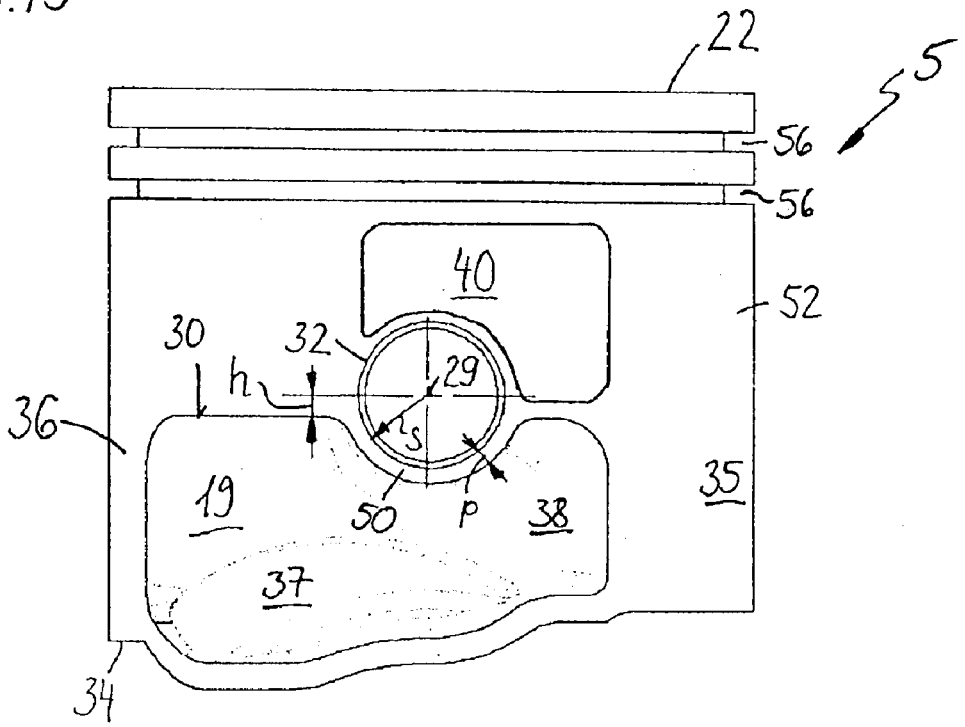

The piston 5 is illustrated in a side view in FIGS. 14 and 15. The base surface of the piston window 19 is inclined by an angle of inclination $\beta$ relative to the rear wall 38. The axis 29 of the connecting rod eye 28 has a spacing h relative to the upper edge 30 of the piston window 19 as viewed in the direction of the longitudinal axis 23 of the cylinder toward the crankcase 4. In this connection, the distance h is less than the radius s of the piston boss 32, in particular being less than 50% of the radius s. The upper edge 30 of the piston window 19 is advantageously offset relative to the axis 29 of the connecting rod eye 28 in a direction toward the crankcase 4 at most by a distance h that corresponds to the radius of the piston boss 32. Disposed in the piston skirt 52 is a cavitation 40 that extends approximately above, i.e. in a direction toward the upper edge 22 of the piston, the piston window 19 on that side 35 of the piston 5 that faces the outlet 10, as well as above the piston boss 32 to below the annular grooves 56 that are provided for the piston rings.

Figure 16:
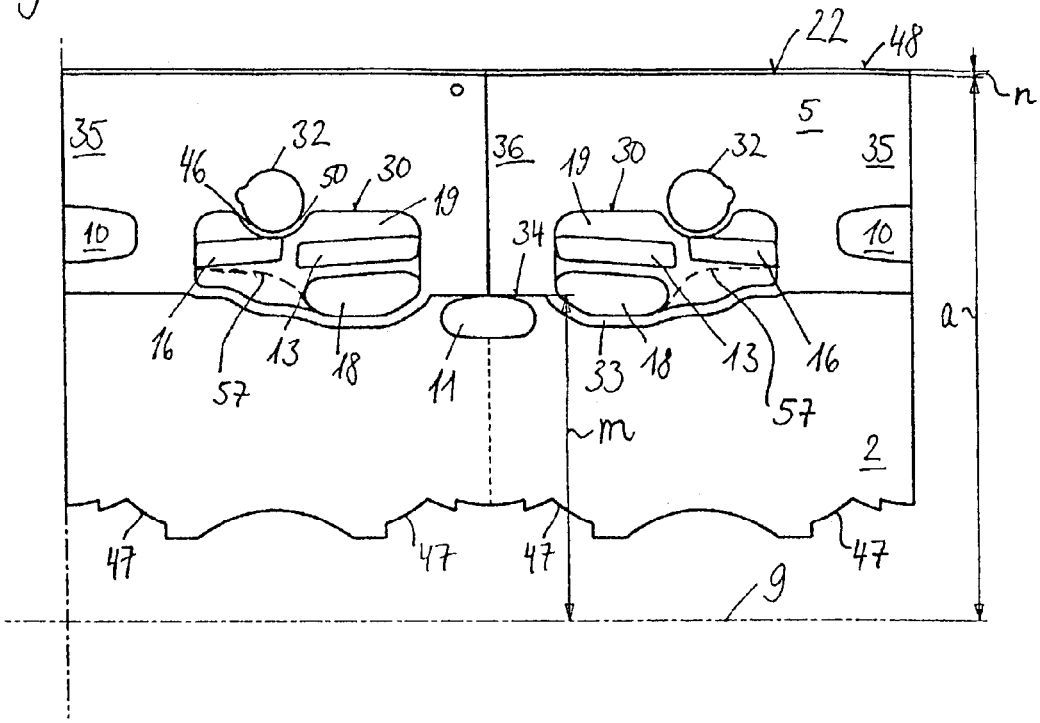
FIG. 16 is a development of the cylinder and piston in the upper dead center position of the piston.
Figure 17:
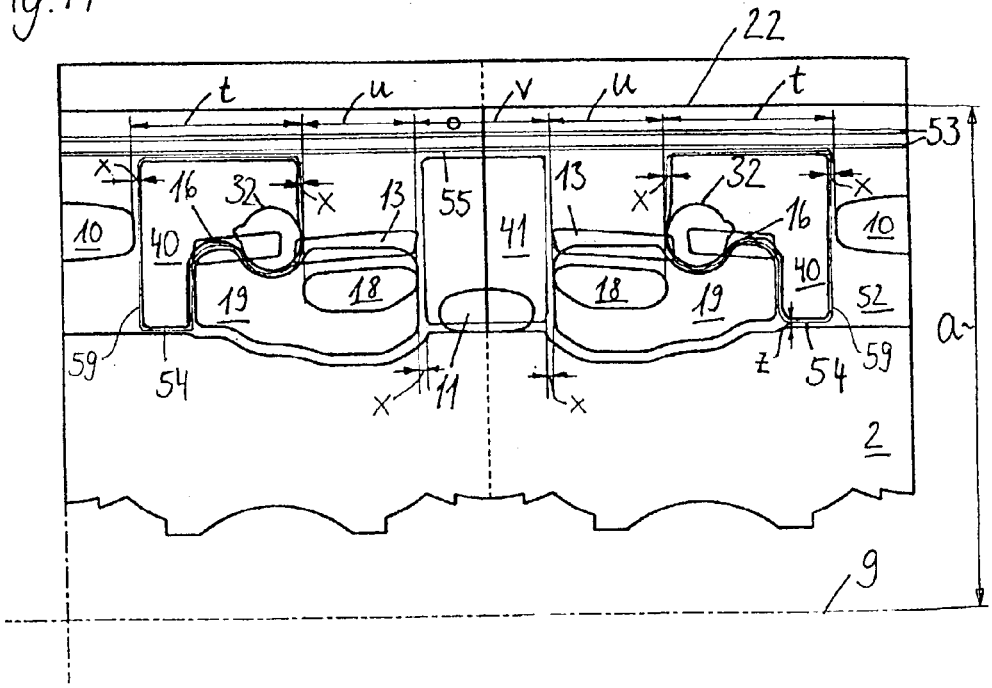
FIG. 17 is a development of the cylinder and piston in a piston position corresponding to FIGS. 5 and 6.
Figure 18:
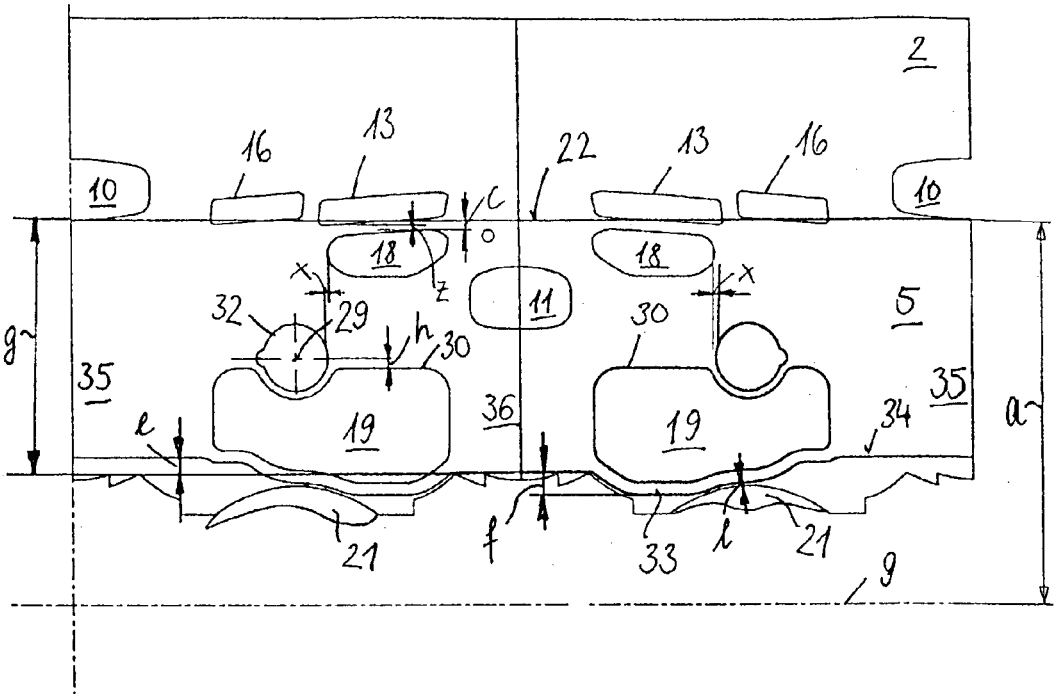
FIG. 18 is a development of a cylinder and piston in the piston position illustrated in FIGS. 7 and 8.

FIGS. 16 to 18 illustrate modifications of the piston 5 and cylinder 2 in various positions of the piston. FIG. 16 shows the piston 5 in the upper dead center position in conformity with the illustration in FIG. 1. The inlet 11 into the crankcase 4 is completely opened. The lower edge 34 of the piston 5 on that side 35 that faces the inlet 11 has a distance m of about 58 mm relative to the axis 9 of the crankshaft 7. The extension 33 of the piston is embodied in such a way that the piston window 19 completely connects the air channel 19 and the inlet windows 13 and 16 of the transfer channels 12 and 15. The piston boss 32 is separated form the piston window 19 by a wall 46. The upper edge 22 of the piston is spaced by a distance of about 98 mm from the axis 9 of the crankshaft 7, whereby the distance a, at a piston stroke of 34 mm and a cylinder bore diameter of 49 mm can be between 90 and 105 mm, especially 94 to 100 mm. The cylinder 2 has four recesses 47 which resulted by a spatial intersection with the crank web 8 having the chamfer angle $\gamma$ and a spacing of 1 to 2 mm. The upper edge 48 of the cylinder is spaced by a distance n of 0.3 to 5.0 mm, especially about 0.8 mm, from the upper edge 22 of the piston. The dashed lines 57 in the piston windows 19 indicate the course of that edge of the piston window 19 that faces the crankcase 4, whereby the piston window has an L-shaped configuration.

In FIG. 17, the piston 5 is illustrated in a position corresponding to the piston position in FIGS. 5 and 6. The inlet 11 is closed off by the piston 5. The symmetrically arranged air channel windows 18 are respectively connected, via the two piston windows 19, with the inlet windows 13 and 16 of the transfer channels 12 and 15. The distance a of the upper edge 22 of the piston relative to the axis 9 of the crankshaft 7 is, in this position, and relative to the ratio of piston stroke to cylinder bore diameter, advantageously approximately 130 mm, whereby values of 115 to 138 mm can be expedient. At a piston stroke of 34 mm, and a cylinder bore diameter of 49 mm, there thus results an advantageous spacing or distance of about 90 mm, whereby distances a of 80 to 95 mm can be advantageous.

Illustrated in FIG. 17 are cavitations 40, 41 that extend from the piston skirt 52 into the interior of the piston 5. During the course of the piston stroke, for example in the piston position illustrated in FIG. 17, the cavitations 40 are connected with the two inlet windows 13, 16 of the two transfer channels 12, 15. The maximum width of the cavitations 40 in the circumferential direction results from the distance t between the outlet 10 and the air channel window 18. The cavitations 40 respectively have a distance x in a circumferential direction relative to the air channel window 18 and the outlet 10. Formed about the cavitations 40 is a sealing member 54 that extends all the way around and that has a sealing groove 59. The sealing member 54 has a width z of at least 1 mm, especially 2 to 4 mm. The cavitations 40 also embrace the piston boss 32. Thus, the piston boss 32 must be sealed relative to the crankcase. A larger possible volume of the cavitation 40 results by integrating the piston boss 32 into the cavitation 40. A further cavitation 41 is fluidically connected with the inlet 11 in certain positions of the piston. The width of the cavitation 41 in the circumferential direction results from the distance v between the two air channel windows 18 in the region of the inlet 11. Also the cavitation 41 has a sealing edge 55 that extends all the way around and respectively has a distance x relative to the air channel windows 18. In the direction toward the upper edge 22 of the piston, the extent of the cavitations 40, 41 is delimited by the piston rings 53.

Figure 19:
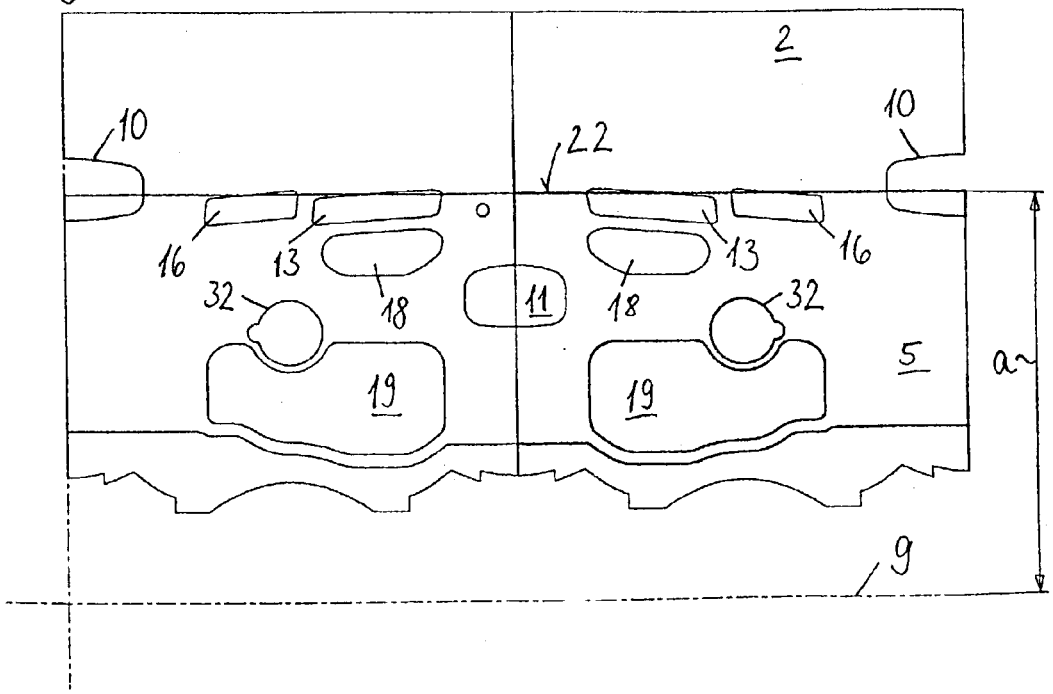
FIG. 19 is a development of a cylinder and piston corresponding to the piston position in FIGS. 9 and 10.

In FIG. 18, the piston 5 is illustrated in a piston position corresponding to FIGS. 7 and 8. The inlet windows 13 and 16 are open relative to the combustion chamber 3, and the piston 5 is disposed in the lower dead center position. The distance a of the upper edge 22 of the piston from the crankshaft axis 9, relative to the ratio of piston stroke to cylinder bore diameter, is 72 to 116 mm, especially 86 to 102 mm. At a piston stroke of 34 mm and a cylinder bore diameter of 49 mm, there results a distance a of 50 to 80 mm, especially 60 to 70 mm. The distance I between the extension 33 of the piston 5 and the ball bearing 21 of the crankshaft 7, or some other part of the crankcase, is expediently about 1 mm. The air channel window 18 is spaced by a distance c relative to the upper edge 22 of the piston that is expediently 0.5 to 5 mm, especially 1 to 3 mm. In FIG. 18, a piston 5 is illustrated that has no cavitations 40, 41. However, to avoid leaks, a distance x is formed in the circumferential direction between the piston bosses 22 and the respectively adjacent air channel windows 18 in the circumferential direction. In FIGS. 18 and 19, the piston rings 53 are not illustrated; however, these extend in conformity with the disposition in FIG. 17.

In FIG. 19, the piston 5 is illustrated in a position in conformity with FIGS. 9 and 10. The inlet windows 13 and 16 of the transfer channels are largely closed off by the piston in this position. In order to achieve good flow conditions in the air channel 17, the piston window 19, and the transfer channels 12 and 15, the surfaces of the transfer channels 13 and 16 and of the air channel 18 are adapted to one another. In order in the transfer channels to achieve an adequate quantity of fresh air for separation of the exhaust gases from the subsequently flowing fuel/air mixture, it is provided that the surface area of one air channel window 18, at a displacement of about 64 $cm^3$, be from 120 to 150 $mm^2$, especially 125 to 140 $mm^2$, and that the sum of the surface areas of an inlet window 13 and of an inlet window 16 be 140 to 180 $mm^2$, especially 150 to 170 $mm^2$. Relative to the displacement volume, there results for the surface areas of an air channel window favorable values of 1.87 to 2.35 $mm^2/cm^3$, especially 1.95 to 2.19 $mm^2/cm^3$, and for the sum of the surface areas of an inlet window 16 of 2.18 to 2.82 $mm^2/cm^3$, especially 2.34 to 2.66 $mm^2/cm^3$. The surface area of the inlet window 13 of the transfer channel 12 that is remote from the outlet is advantageously greater than the surface area of the inlet window 16 of the transfer channel 15 that is close to the outlet window. It is provided that the surface area of the inlet window 16 of the transfer channel 15 that is near the outlet be 50 to 90% of the surface area of the inlet window 13 of the transfer channel 12 that is remote from the outlet, especially being 60 to 80%.

To reduce the weight of the piston, the latter has recesses and undercuts, especially in the region between piston boss and upper edge of the piston.

Favorable conditions result if the connection between piston window 19 and air channel 18 is established in a piston position that corresponds to a crank angle $\alpha$ of about 260 to 310°. The air channel window 18 is advantageously disposed directly below the inlet windows 13, 16 so that the air channel windows 18 and the inlet windows 13, 16 open nearly simultaneously to the piston window 19. For this purpose, the air channel window 18 advantageously has a lesser extension in the direction of the longitudinal axis 23 of the cylinder. It can also be advantageous to partially or entirely dispose the air channel window 18 next to the inlet windows 13, 16 in the circumferential direction.

Figure 20:
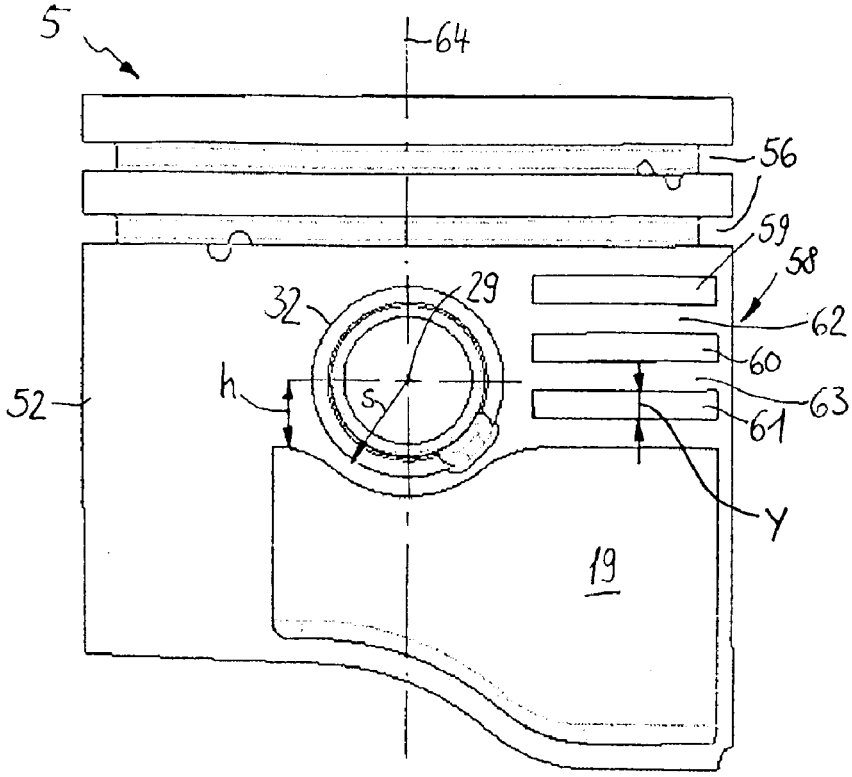
FIG. 20 is a side view onto a piston.
Figure 21:
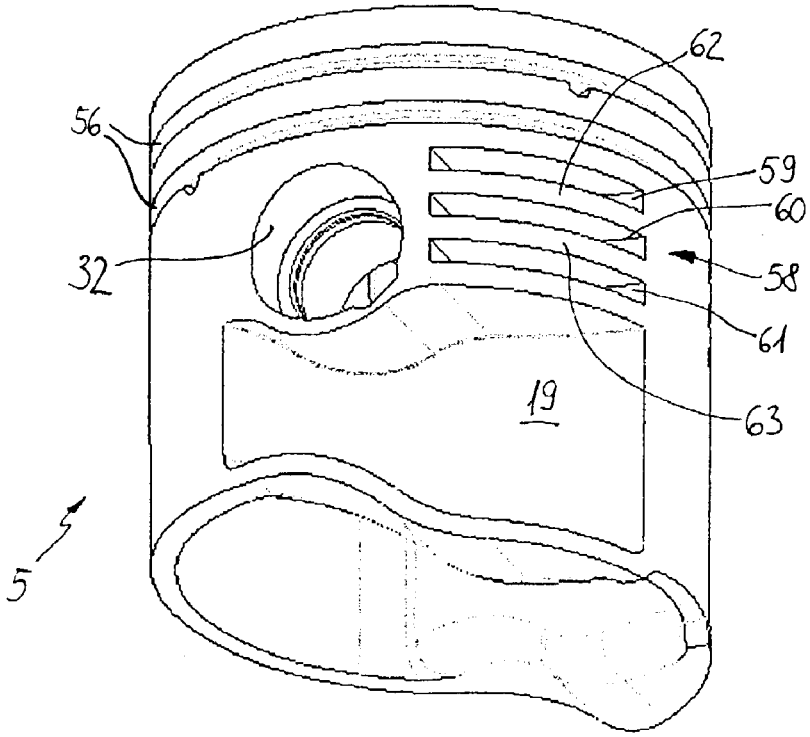
FIG. 21 is a perspective illustration of the piston of FIG. 20

FIGS. 20 and 21 illustrate a piston 5 having a piston window 19. The piston 5 has a cavitation 58 that, proceeding from the piston skirt 52, extends in a direction toward the interior of the piston 5. In so doing the cavitation 58 forms no connection in the interior of the piston. In the direction of the longitudinal central axis 64 of the piston 5, the cavitation 58 is divided into three individual cavitations 59, 60 and 61, which are separated from one another by ribs 62, 63 that extend perpendicular to the central longitudinal axis 64. The ribs 62, 63 serve as sealing members and prevent a flow from the air channel window 18 to the inlet window 19 as the piston passes these opening during a piston stroke. The height y of a cavitation 59, 60, 61, as measured in the direction of the longitudinal axis 64 of the piston, is in this connection expediently less than the distance z (FIG. 18) between the air channel 18 and the inlet window 13 measured in the direction of the longitudinal axis of the cylinder. This avoids a flow between air channel window 18 and inlet window 13 via a cavitation 59, 60, 61. The individual cavitations 59, 60, 61 are disc-shaped with a curved rear wall, and can be introduced into the piston skirt 52 via a side-milling cutter. Providing the cavitation 58 with ribs leads to a good guidance of the piston 5. In conformity with the cavitations 40 and 41, during a piston stroke the cavitation 58 is in communication with only one functional opening. Relative to the arrangement of sealing members and relative to the distances to other functional openings, the cavitation 58 corresponds to the cavitations 40 and 41.

The specification incorporates by reference the disclosure of German priority document 102 23 068.4 filed May 24, 2002.

The present invention is, of course, in no way restricted to the specific disclosure of the specification and drawings, but also encompasses any modifications within the scope of the appended claims.

What is claimed is:

1. A two-cycle engine, comprising:

a cylinder in which is formed a combustion chamber that is delimited by a reciprocating piston that, via a connecting rod, drives a crankshaft that is rotatably mounted in a crankcase, wherein said connecting rod is connected to said piston at an eye of said connecting rod, wherein said piston has a piston boss for connecting said piston with said connecting rod, wherein an outlet is provided for discharging exhaust gas from said combustion chamber, wherein an inlet is disposed approximately opposite said outlet for supplying a fuel/air mixture to said crankcase, wherein said at least one transfer channel is provided for a passage of said fuel/air mixture out of said crankcase into said combustion chamber, wherein a first end of said at least one transfer channel opens into said combustion chamber via an inlet window and a second end communicates with said crankcase, wherein at least one air channel is provided that supplies essentially fuel-free gas and that has a window that is disposed in a region of said cylinder that in every position of said piston is separated by said piston from said crankcase and said combustion chamber, wherein a piston window is provided that in a given position of said piston establishes a fluidic connection between said window of said at least one air channel and said inlet window of said at least one transfer channel, and wherein an upper edge of said piston window is spaced, when viewed in the direction of a longitudinal axis of said cylinder, by a distance from an axis of said connecting rod eye that is less than a radius of said piston boss.

2. A two-cycle engine according to claim 1, wherein said distance of said upper edge of said piston window from said connecting rod eye axis is less than 50% of said radius of said piston boss.

3. A two-cycle engine according to claim 2, wherein a first sealing member is provided that extends about said piston boss, wherein in a direction toward said piston window said first sealing member has a width of 2 to 4 mm, wherein a radial distance between said first sealing member and an inner wall of said cylinder, in every position of said piston, is at most 0.1 mm, and wherein said first sealing member is provided with at least one circumferential sealing groove.

4. A two-cycle engine according to claim 3, wherein said radial distance between said first sealing member and said inner wall of said cylinder is less than 50 $\mu$m.

5. A two-cycle engine according to claim 1, wherein a lower edge of said piston, on a side of said piston that faces said outlet, is, relative to a side of said piston that faces said inlet, offset in a direction toward an upper side of said piston, and wherein two air channel windows and four transfer channels are disposed symmetrically relative to said longitudinal axis of said cylinder.

6. A two-cycle engine according to claim 1, wherein said piston, in a region of said piston window, is extended in a direction toward said crankcase, and wherein a height of such extension of said piston window, in a direction of said longitudinal axis of said cylinder, is less than 15% of a piston height on a side of said piston that faces said inlet.

7. A two-cycle engine according to claim 6, wherein the height of said extension of said piston window is less than 10% of said piston height.

8. A two-cycle engine according to claim 1, wherein said piston window has an approximately L-shaped configuration, and wherein a short leg of said L extends downwardly in a direction of said longitudinal axis of said cylinder.

9. A two-cycle engine according to claim 1, wherein a crank web is provided that, on a side thereof that faces said crankcase, is provided with a flattened portion that is embodied as a chamfer having a chamfer angle, and wherein a base surface of said piston window is inclined relative to a rear wall of said piston window by an angle of inclination of greater than 90°.

10. A two-cycle engine according to claim 9, wherein said angle of inclination corresponds to said chamfer angle and is 120 to 150°.

11. A two-cycle engine according to claim 1, wherein in an upper dead center position of said piston, a distance between an upper edge of said piston and an axis of said crankshaft, relative to a ratio of piston stroke to cylinder bore diameter, is 130 to 153 mm, wherein in a lower dead center position of said piston said distance between said upper edge of said piston and said crankshaft, relative to said ratio of piston stroke to cylinder bore diameter, is 72 to 116 mm, wherein in said lower dead center position of said piston a distance between said air channel window and said upper edge of said piston is 0.5 to 5.0 mm, and wherein in said lower dead center position of said piston a distance between a lower edge of said piston and a bearing means of said crankshaft is 0.5 to 5.0 mm.

12. A two-cycle engine according to claim 11, wherein said distance between said upper edge of said piston and said crankshaft axis is 137 to 145 mm in said upper dead center position of said piston and is 86 to 102 mm in said lower dead center position of said piston, and wherein in said lower dead center position of said piston said distance between said air channel window and said upper edge of said piston is 1.0 to 3.0 mm and said distance between said lower edge and said bearing means is approximately 1.0 mm.

13. A two-cycle engine according to claim 1, wherein said air channel window is offset relative to at least one inlet window of said at least one transfer channel in the direction toward said crankcase.

14. A two-cycle engine according to claim 13, wherein said air channel window has a positive spacing relative to said at least one inlet window.

15. A two-cycle engine according to claim 1, wherein said piston is provided with a cavitation that extends from a piston skirt in the direction toward an interior of said piston, whereby said cavitation, during the course of a piston stroke, is fluidically connected with only one functional opening into an interior of said cylinder, wherein said cavitation establishes no fluidic connection to said crankcase, wherein said cavitation has a spacing, in a circumferential direction, to all functional openings with which it is not connected during a course of a piston stroke, wherein said cavitation is provided with at least one circumferential second sealing member, wherein a width of said second sealing member is at least 1 mm, and wherein said second sealing member has at least one circumferential sealing groove.

16. A two-cycle engine according to claim 15, wherein said cavitation during the course of the piston stroke, is fluidically connected with at least one inlet window of one transfer channel, and wherein said second sealing member has a width of 2 to 4 mm.

17. A two-cycle engine according to claim 15, wherein said cavitation is composed of a plurality of individual cavitations and wherein said individual cavitations are separated from one another by ribs.

18. A two-cycle engine according to claim 1, wherein said piston window has an overall volume that corresponds approximately to 4 to 14% of a displacement of said two-cycle engine.

19. A two-cycle engine according to claim 1, wherein at least one third sealing member is provided on said piston window that extends all the way around, wherein said third sealing member has a width between said piston window and said crankcase of at least 1 mm, and wherein at least one third sealing member is provided with at least one circumferential sealing groove.

20. A two-cycle engine according to claim 19, wherein said width of said third sealing member is 2 to 4 mm.

* * * * *